US005704182A

United States Patent [19]

Schiedegger

[11] Patent Number: 5,704,182

[45] Date of Patent: Jan. 6, 1998

[54] MODULAR SHUTTER ASSEMBLY

[75] Inventor: Charles E. Schiedegger, Metamora, Mich.

[73] Assignee: Tapco International, Plymouth, Mich.

[21] Appl. No.: 468,192

[22] Filed: Jun. 6, 1995

[51] Int. Cl.[6] ..... E06B 9/00; E06B 7/08

[52] U.S. Cl. ..... 52/457; 52/455; 52/458; 52/473; 52/762; 52/775; 52/745.15; 52/745.19; 52/311.2; 52/314

[58] Field of Search ..... 52/455, 457, 458, 52/473, 762, 764, 775, 745.15, 745.16, 745.19, 798.1, 800.1, 800.11, 800.12, 309.1, 98, 313, 314, 784.13, 311.2; 156/73.1, 73.4

[56] References Cited

U.S. PATENT DOCUMENTS

| | | | |
|---|---|---|---|
| 3,121,977 | 2/1964 | Bersudsky | 52/314 |
| 3,543,464 | 12/1970 | Taylor | 52/455 |
| 3,731,444 | 5/1973 | Tobin | 52/455 X |
| 3,932,959 | 1/1976 | Jansons et al. . | |
| 4,023,320 | 5/1977 | Jackson | 52/473 |
| 4,251,966 | 2/1981 | Foltman . | |
| 4,765,110 | 8/1988 | MacLeod . | |
| 4,901,493 | 2/1990 | Thorn | 52/455 X |
| 4,915,758 | 4/1990 | Baggett, Jr. et al. | 156/73.1 |
| 4,939,880 | 7/1990 | Wang | 52/473 |
| 5,060,442 | 10/1991 | Chubb . | |
| 5,152,116 | 10/1992 | MacGowan . | |
| 5,265,391 | 11/1993 | Ricard et al. | 52/455 |
| 5,347,782 | 9/1994 | Vagedes | 52/473 |
| 5,459,972 | 10/1995 | Eckel | 52/456 |
| 5,526,857 | 6/1996 | Forman | 52/311.2 X |
| 5,540,026 | 7/1996 | Gartland | 52/455 |
| 5,617,688 | 4/1997 | Gandy et al. | 52/800.12 X |

FOREIGN PATENT DOCUMENTS

| | | | |
|---|---|---|---|
| 259759 | 6/1965 | Australia | 52/98 |

OTHER PUBLICATIONS

"Master Shutters" and Style –A–Shutter Brochures, Mid–America Building Products Corporation.

"The Vixen Hill Cedar Shutter" Brochure, Vixen Hill Manufacturing Company, Inc.

*Primary Examiner*—Wynn E. Wood

*Assistant Examiner*—Laura A. Saladino

*Attorney, Agent, or Firm*—Harness, Dickey & Pierce, P.L.C.

[57] ABSTRACT

A modular plastic shutter assembly that includes an injection molded panel that has been cut to length to accommodate the particular shutter assembly. A die cutter having an appropriately shaped cutting blade cuts an end of the panel to the desirable length. A separate injection molded panel end piece is secured to the cut end of the panel to form a complete panel.

16 Claims, 4 Drawing Sheets

Fig - 1
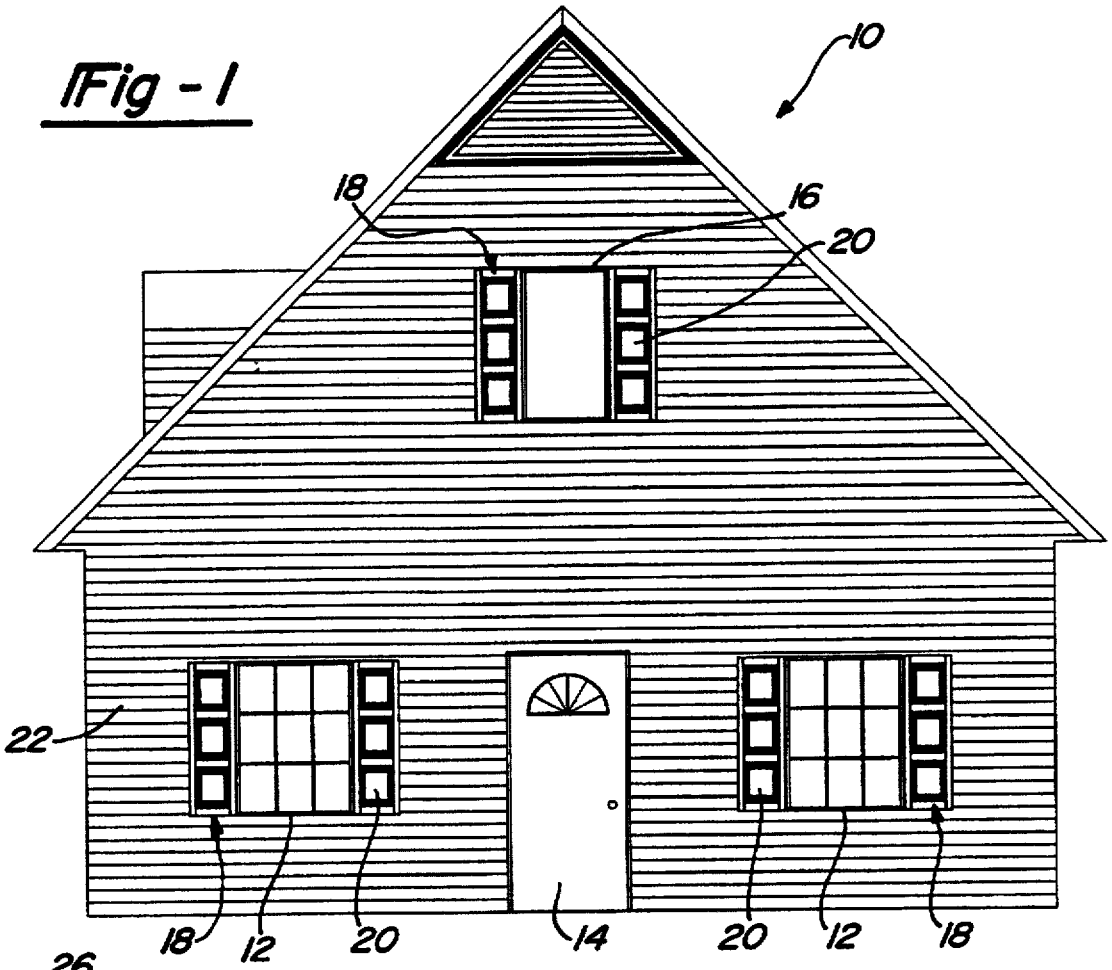
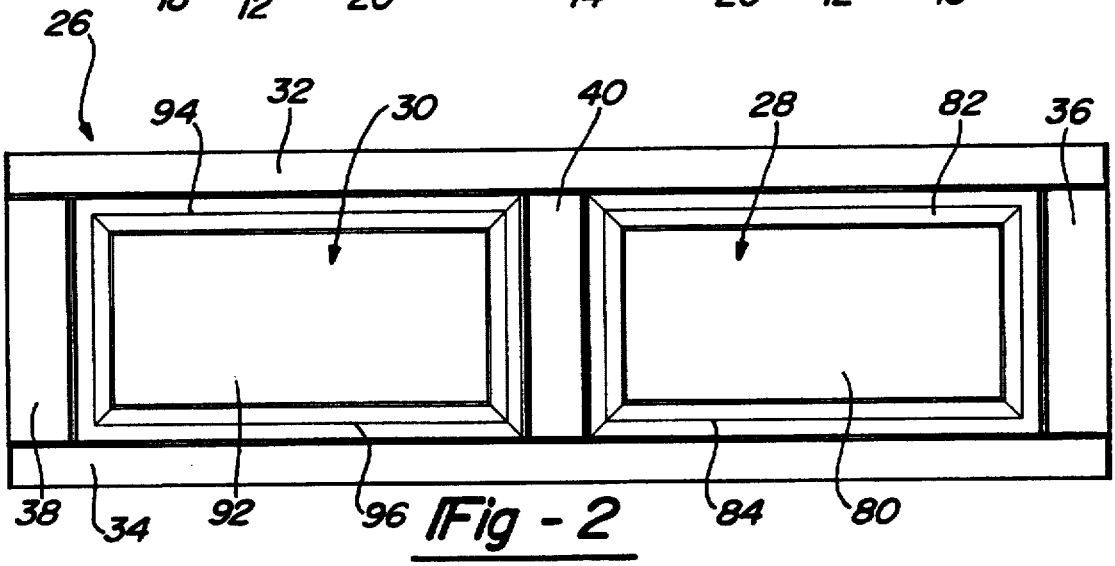
Fig - 2

Fig-3
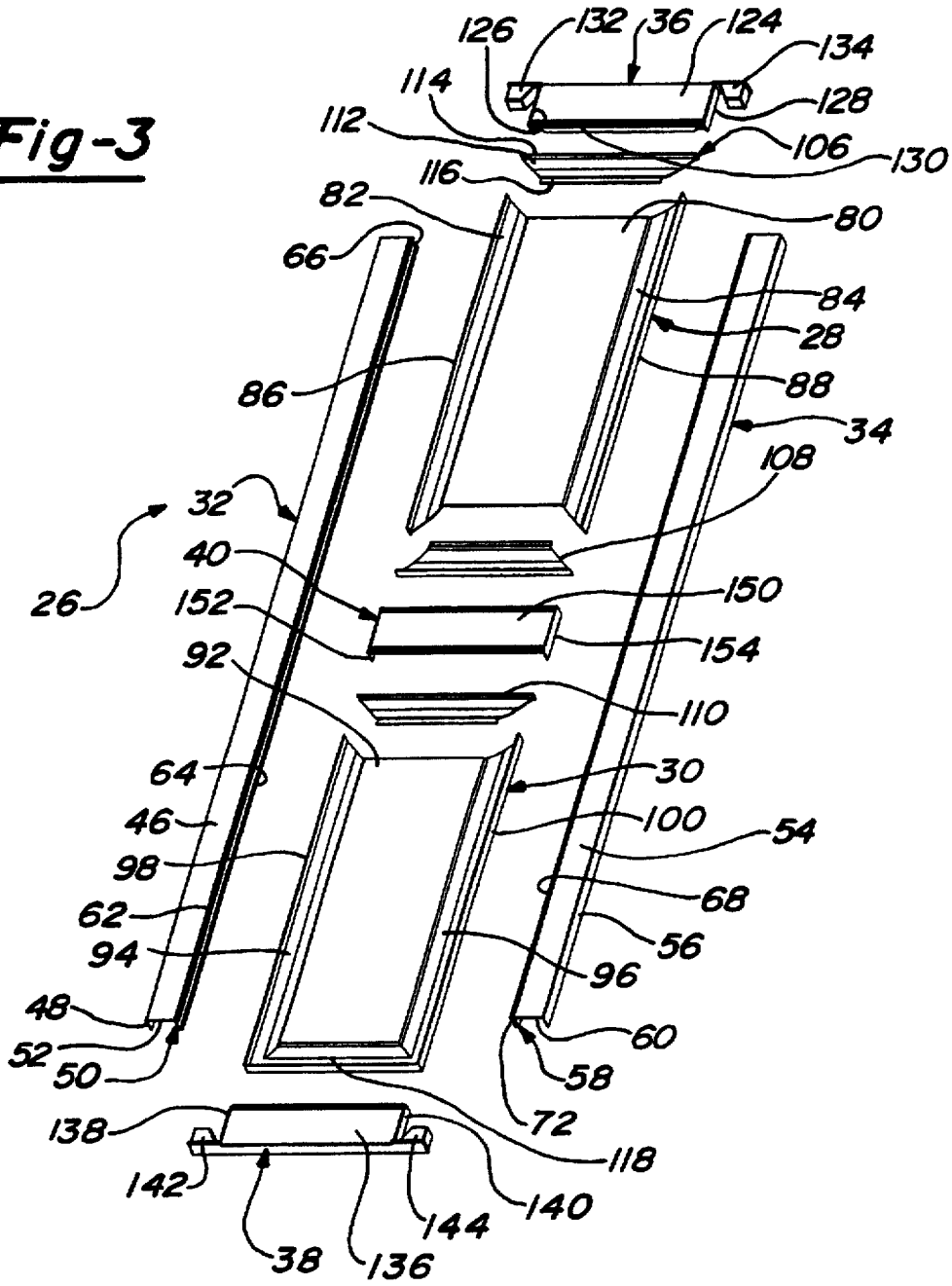
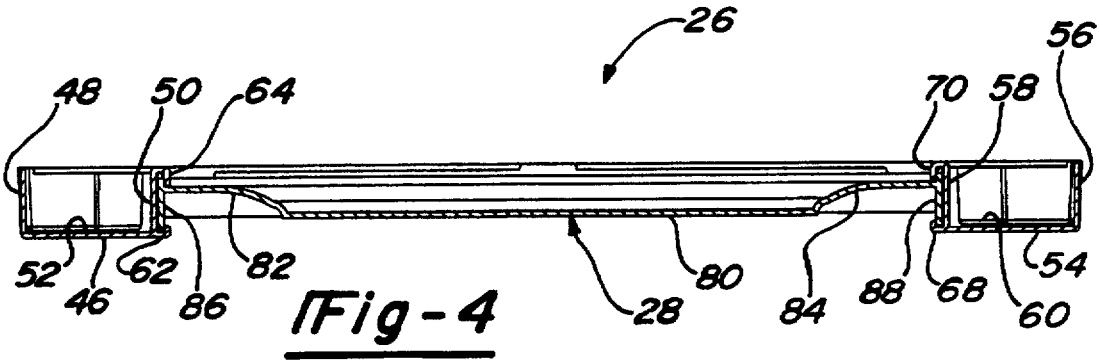
Fig-4

MODULAR SHUTTER ASSEMBLY

CROSS-REFERENCE TO RELATED APPLICATIONS

This application is related to U.S. patent application Ser. No. 08/465,741 entitled "Shutter and Method of Assembling Same," filed Jun. 6, 1995, concurrently herewith.

BACKGROUND OF THE INVENTION

1. Field of the Invention

This invention relates generally to a modular shutter assembly and, more particularly, to a plastic modular shutter assembly including at least one panel that has been die cut to a desirable length so that a single size injection molded panel can be cut to accommodate a different number of panels and/or different length shutter assemblies.

2. Discussion of the Related Art

Many different modern building designs take advantage of modular shutters for purely aesthetic purposes to decorate exterior windows. FIG. 1 shows an exterior front view of a house 10 that includes two lower story front windows 12 positioned on opposite sides of a door 14 and an upper story front window 16. The layout and style of the windows 12 and 16 show different types of popular window designs for different types of houses or other buildings. Positioned on both sides of each of the windows 12 and 16 is a modular shutter assembly 18 where each shutter assembly 18 includes a plurality of panels 20, here three panels 20. The modular shutter assemblies 18 are rigidly secured to a front wall 22 of the house 10 by appropriate securing devices (not shown) known in the art at a location that aesthetically accents the windows 12 and 16. The shutter assemblies 18 do not provide a functional purpose to the windows 12, but are provided for only aesthetic reasons.

The modular shutter assemblies 18 are an assembly of plastic parts that are individually formed and then secured together in a cost effective manner. The different plastic parts may be formed by different plastic fabrication techniques such as injection molding and extrusion. The plastic parts are secured together by appropriate fastening mechanisms, such as screws, adhesive, etc., in a manner that is well understood in the art. U.S. Pat. No. 5,152,116 issued to MacGowan on Oct. 6, 1992, U.S. Pat. No. 5,060,442 issued to Chubb on Oct. 29, 1991 and U.S. Pat. No. 4,765,110 issued to Macleod on Aug. 23, 1988 disclose plastic modular shutter assemblies of the type being discussed herein.

Because the windows of a house or other building can come in various sizes, the length and width of the modular shutter assemblies 18 must also be available in different lengths and widths to appropriately accommodate the different windows. For example, for windows having a different height than that of the windows 12 and 16, it is necessary that the panels 20 come in different lengths to extend the length of the shutter assemblies 18 and appropriately accent the lengths of the windows. Because known panels 20 are typically injection molded plastic parts, different size molds have heretofore been necessary to provide for different length panels 20. As is well understood, injection molds are relatively expensive components. Because the shutter assemblies 18 are relatively inexpensive articles, the necessity to provide many different sized molds for all of the different sized windows significantly adds to the cost of the shutter assemblies 18.

In order to at least eliminate some of the costs associated with the need for many molds to generate different length panels for known modular shutter assemblies, it would be desirable to provide a single mold for each of the different panel types that was of a size to accommodate the greatest length panel necessary, and then provide a mechanism for reducing the length of the panel to accommodate shorter length shutters. It is therefore an object of the present invention to provide such a mechanism.

SUMMARY OF THE INVENTION

In accordance with the teachings of the present invention, modular plastic shutter assemblies are disclosed that include panels that are injection molded and then cut to length to accommodate different length shutter assemblies. In order to provide different length panels, the present invention proposes providing a shutter panel mold that is large enough to fabricate the longest length shutter panel desirable. Once the shutter panels are molded by the injection molding process, the panels are introduced to a die cutting step that die cuts an end of the panel to provide a panel of the appropriate length for a particular shutter application. A separate injection mold provides panel end pieces to replace the cut portions of the panel to form a complete panel of the desirable length.

Additional objects, advantages, and features of the present invention will become apparent from the following description and appended claims, taken in conjunction with the accompanying drawings.

BRIEF DESCRIPTION OF THE DRAWINGS

FIG. 1 is a front view of a house including a number of modular shutter assemblies according to an embodiment of the present invention;

FIG. 2 is a front view of a modular shutter assembly including two die cut panels according to an embodiment of the present invention;

FIG. 3 is a blown apart perspective view of the shutter assembly of FIG. 2;

FIG. 4 is a cut-away view of the shutter assembly of FIG. 2;

DETAILED DESCRIPTION OF THE PREFERRED EMBODIMENTS

Figure 5:
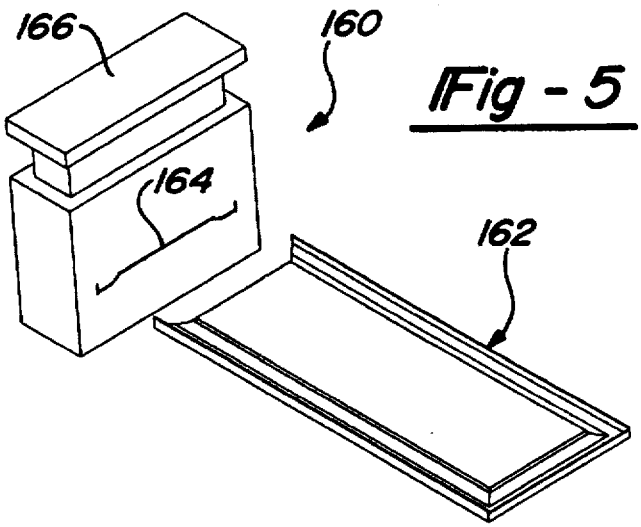
FIG. 5 is a perspective view of a panel of a modular shutter assembly of the invention positioned relative to a die cutter.

The following discussion of the preferred embodiments directed to a modular shutter assembly including a die cut panel is merely exemplary in nature and is in no way intended to limit the invention or its applications or uses.

FIG. 2 shows a front view, FIG. 3 shows a blown apart perspective view and FIG. 4 shows a cross-sectional view of a modular shutter assembly 26 according to an embodiment of the present invention. The shutter assembly 26 includes a pair of panels 28 and 30, a pair of laterally spaced side rails 32 and 34, a pair of end rail sections 36 and 38, and a center section 40 that separates the panels 28 and 30 that are assembled together as shown. Each of the panels 28 and 30, the side rails 32 and 34, the end rail sections 36 and 38, and the center section 40 are made of a suitable plastic that has been formed to the shape shown. In one embodiment, the side rails 32 and 34 are formed by an extrusion process and the remaining parts are formed by an injection molding process. Of course, other plastic forming processes may be applicable.

The side rail 32 includes a front wall 46 and a pair of laterally spaced flanges 48 and 50 extending perpendicularly from the back of the wall 46 to define a C-shaped channel 52. Likewise, the side rail 34 includes a front wall 54 and a pair of laterally spaced flanges 56 and 58 extending perpendicularly from the back of the wall 54 to define a C-shaped channel 60. The flange 50 includes a pair of inwardly and oppositely turned flanges 62 and 64 that define a track 66 extending the length of the side rail 32. The flange 58 includes a pair of inwardly and oppositely turned flanges 68 and 70 that define a track 72 extending the length of the side rail 34.

The panel 28 includes a raised planar portion 80 and an opposite pair of angled side edge portions 82 and 84. The combination of the planar portion 80 and the edge portions 82 and 84 define a panel shape that adds to the aesthetic appeal of the shutter assembly 26. Other aesthetically pleasing shapes of the panel 28 can also be provided for other shutter assemblies by suitable molds. A side runner flange 86 extends perpendicularly from the edge portion 82 and a side runner flange 88 extends perpendicularly from the edge portion 84. The runner flanges 86 and 88 are appropriately dimensioned to be slidably engaged within the tracks 66 and 72, respectively, of the side rails 32 and 34 so as to secure the panel 28 to the side rails 32 and 34. The runner flange 86 is introduced into one end of the track 66 and is slidably engaged along the track 66 behind the flanges 62 and 64, while at the same time, the runner flange 88 is introduced into the same end of the track 72 and is slidably engaged along the track 72 behind the flanges 68 and 70 until the panel 28 is positioned at a desirable location. A more detailed discussion of a shutter panel of this type that includes side runner flanges that engage tracks of side rails can be found in U.S. Pat. No. 4,765,110 referenced above.

Likewise, the panel 30 includes a raised planar portion 92 and an opposite pair of angled side edge portions 94 and 96. The edge portions 94 and 96 are formed into the same shape as the edge portions 82 and 84. A side runner flange 98 extends perpendicularly from the edge portion 94 and a side runner flange 100 perpendicularly extends from the edge portion 96. The runner flanges 98 and 100 are appropriately dimensioned to be slidably engaged within the tracks 66 and 72, respectively, of the side rails 32 and 34 so as to secure the panel 30 to the side rails 32 and 34. The runner flange 98 is introduced into one end of the track 66 and is slidably engaged along the track 66 behind the flanges 62 and 64, while at the same time, the runner flange 100 is introduced into the same end of the track 72 and is slidably engaged along the track 72 behind the flanges 68 and 70 until the panel 30 is positioned at a desirable location.

The panel 28 includes panel end sections 106 and 108, and the panel 30 includes a panel end section 110. Each of the end sections 106, 108 and 110 are separately molded independently from the panels 28 and 30 by an appropriate injection mold (not shown). The panel end section 106 includes an angled base portion 112 that conforms to the shape of the edge portions 82 and 84. Additionally, the panel end section 106 includes a runner flange 114 that aligns with the runner flanges 86 and 88. A flange 116 extends from the base portion 112 opposite to the runner flange 114 and provides a surface that allows the end section 106 to be secured to a back surface of the planar portion 80 of the panel 28 by an appropriate fastening mechanism. The panel end sections 108 and 110 include identical features to that of the panel end section 106. For reasons that will become apparent from the discussion below, the panel 30 only includes the single end section 110. An end portion 118 of the panel 30 is integrally molded with the planar portion 92 and the edge portions 94 and 96 of the panel 30.

The end rail section 36 includes a base portion 124 having opposite side edge portions 126 and 128 that extend perpendicularly from a back surface of the base portion 124, and a front edge portion 130. A wing portion 132 extends from the side portion 126, and a wing portion 134 extends from the side portion 128. The wing portions 132 and 134 are appropriately shaped to be slidably inserted into the channels 52 and 60, respectively, to secure the end rail section 36 to the side rails 32 and 34. Likewise, the end rail section 38 includes a base portion 136 having opposite side edge portions 138 and 140 that extend perpendicularly from a back surface of the base portion 136. A wing portion 142 extends from the side portion 138, and a wing portion 144 extends from the side portion 140. The wing portion 142 is slidably engageable within the channel 52 and the wing portion 144 is slidably engageable within the channel 60 to secure the end section 38 to the side rails 32 and 34. A more detailed discussion of securing end rails of the type of the end sections 36 and 38 to the side rails 32 and 34 can be found in U.S. Pat. No. 4,765,110 referenced above.

The center section 40 separates the panels 28 and 30 and is appropriately dimensioned to conform with the size of the end rail sections 36 and 38, as shown. The center section 40 includes a planar base portion 150 and opposite side rail flanges 152 and 154 extending perpendicularly from the base portion 150. As with the runner flanges 86, 88, 98 and 100 discussed above, the rail flanges 152 and 154 are appropriately configured to slidably engage within the channels 66 and 72, respectively. A more detailed discussion of a center section of the type of the center section 40 secured to the side rails of a modular shutter assembly can be found in U.S. Pat. No. 4,765,110 referenced above.

Different mechanisms are available to secure the different pieces of the shutter assembly 26 discussed above in place during assembly of the shutter assembly 26. For example, appropriate staples can be employed to hold and secure the different pieces of a plastic modular shutter assembly together. Additionally, it is possible to use an appropriate adhesive to secure the different pieces together. As set out in copending U.S. patent application Ser. No. (attorney docket no. 7238M-00005), titled "Shutter and Method of Assembling Same," assigned to the assignee of the present invention and herein incorporated by reference, the different shutter pieces can be secured together by an ultrasonic welding process.

As mentioned above, modular shutter assemblies of the type of the shutter assembly 26 are presently fabricated in different sizes. For example, a shutter assembly of the type of the shutter assembly 26 may have panels of widths for example 12, 14½, 16½ or 18 inches wide, and lengths for example 31, 35, 39, 43, 47, 51, 55, 59, 63, 67, 71, 75 or 79 inches long. Because the panels of these types of shutter assemblies are injection molded plastic parts, a different mold has heretofore been required for each different size panel. However, as shown with particularity in FIG. 3, the panels 28 and 30 of the present embodiment are not single piece panels that have been injection molded as a single unit. The panels 28 and 30 have been cut from a larger panel after the larger panel was molded as a single unit. The panel end sections 106, 108 and 110 are molded separately from the panels 28 and 30, and are later secured to the panels 28 and 30 during an assembly step. The panel 30 includes only a single panel end section 110 because the end portion of the panel 30 was molded integrally with the panel 30. The opposite end of the panel 30 was later cut by an appropriate die cutter (discussed below) to a length that was appropriate for the particular shutter assembly 26. The panel 28 was die cut at both ends to have an appropriate length for the shutter assembly 26.

Figure 6:
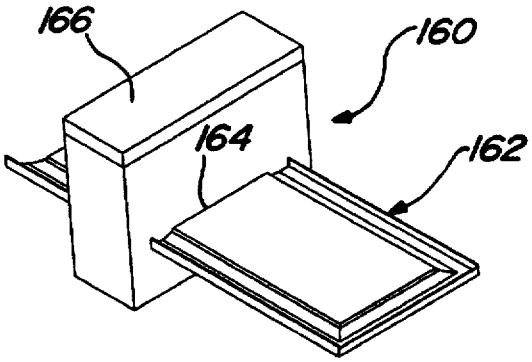
FIG. 6 is a perspective view of the panel and die cutter of FIG. 5 where the panel is within the die cutter to be cut to a desirable length.

Turning to FIG. 5, a perspective view of a die cutter 160 positioned relative to a panel 162 is shown according to the invention. The panel 162 is intended to represent either of the panels 28 and 30, as well as other differently shaped panels within the scope of the invention. The die cutter 160 includes an opening 164 that is appropriately shaped to accept the cross-sectional shape of the panel 162. FIG. 6 shows the panel 162 inserted within the opening 164 of the die cutter 160 at a desirable location. Once the panels 162 is located within the die cutter 160 at a position that will generate a panel of the desirable length, a cutter 166 is pushed downwards so that a blade (not shown) associated with the cutter 166 cuts the panel 162 to the desired length. The cutter 166 is pushed downwards by an appropriate mechanism (not shown), such as a hydraulically or pneumatically driven device in a manufacturing situation, as would be well understood to one of skill in the art.

Figure 7:
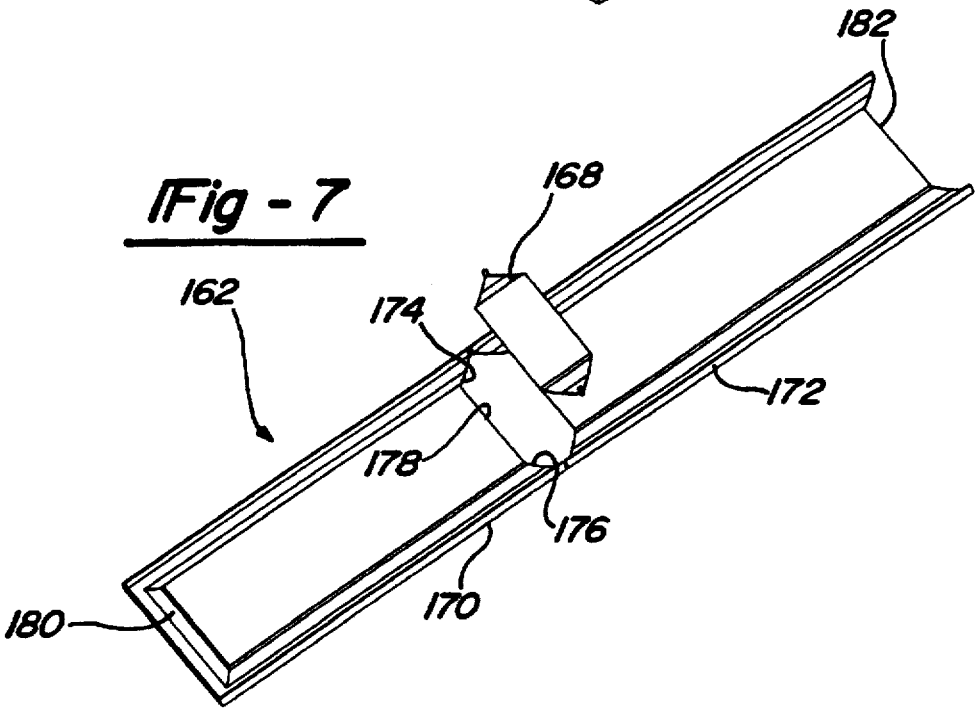
FIG. 7 is a perspective view of the panel of FIG. 5 after it has been die cut by the die cutter where a die cut portion of the panel is shown separated from the panel.

FIG. 7 shows the panel 162 after it has been cut to length by the die cutter 160. The shape of the blade of the cutter 166 separates a cut-away portion 168 of the panel 162 to produce a panel portion 170 of the desirable length and a remaining panel portion 172, as shown. The cut-away portion 168 defines angled side edges 174 and 176 having substantially 45° angles, and a straight base edge 178, as shown. The remaining panel portion 172 can be reintroduced into the die cutter 160 to again be cut to a desirable length for alternate panels. In a specific example, the panel portion 170 could be the panel 30, and the remaining panel portion could be the panel 28. In one embodiment, the injection mold that forms the panel 162 molds the panel 162 have an integral panel end portion 180 and a formed end portion 182 that is in the shape of the cut made by the die cutter 160.

Figure 8:
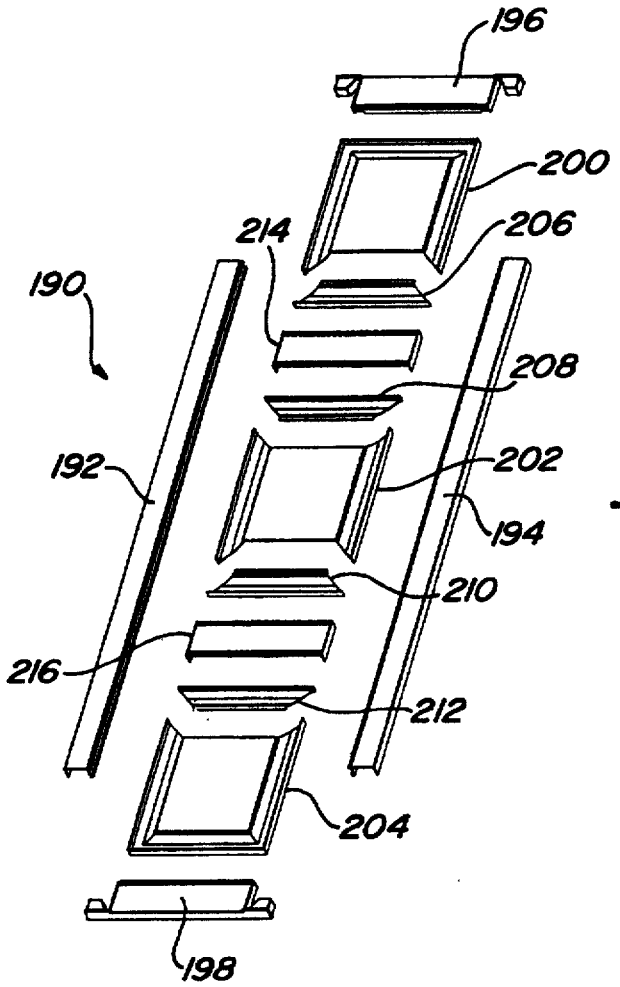
FIG. 8 is a blown apart perspective view of another shutter assembly according to an embodiment of the present invention.

Different modular shutter designs allow the panels 28 and 30 to be replaced with other types and sizes of panels. For example, FIG. 8 shows a blown apart perspective view of a modular shutter assembly 190 of the invention. The shutter assembly 190 includes side rails 192 and 194 of the same type as the side rails 32 and 34. Additionally, the shutter assembly 190 includes end rail sections 196 and 198 of the same type as the end rail sections 36 and 38, above. Instead of two panels 28 and 30, the shutter assembly 190 includes a three panel configuration including panels 200, 202 and 204. The panels 200–204 are cut to length by the die cutter 160 to be of the appropriate length for the particular application desired for the shutter assembly 190. The panels 200–204 include end sections 206, 208, 210 and 212 of the same type as the end sections 106, 108 and 110, above. A center section 214 separates the panels 200 and 202, and a center section 216 separates the panels 202 and 204 in the same manner that the center section 40 separated the panels 28 and 30. The shutter assembly 190 is assembled in the same manner as the shutter assembly 26, above.

Figure 9:
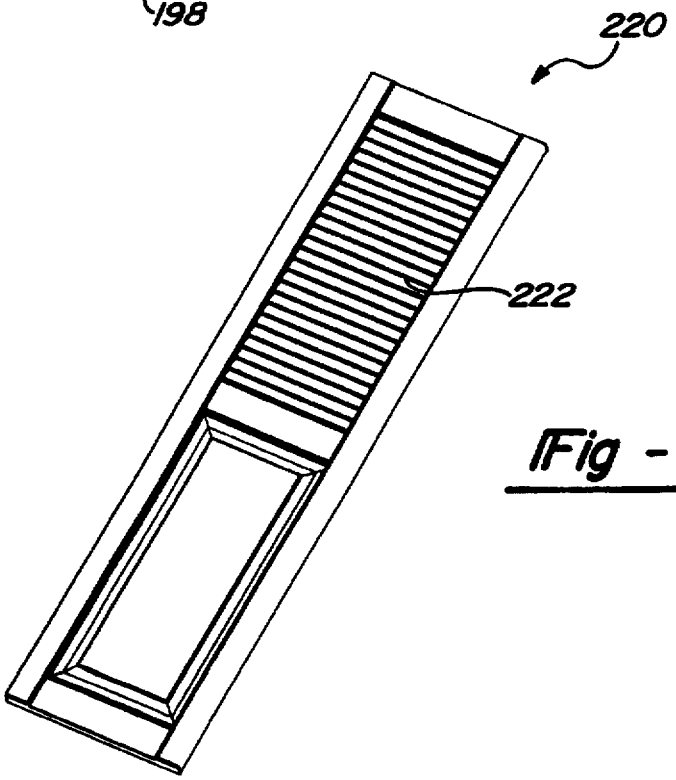
FIG. 9 is a perspective view of another modular shutter assembly according to an embodiment of the present invention.

FIG. 9 shows a perspective view of a shutter assembly 220 of the same type as the shutter assembly 26 where the panel 28 has been replaced by a panel louver 222 to depict yet another type of shutter panel design. The louver panel 222 is of the same type of louver panel as that disclosed in U.S. Pat. No. 4,765,110 referenced above.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A modular shutter assembly comprising:

first and second side rails extending a length of the shutter assembly along first and second sides of the shutter assembly;

first and second shutter end sections positioned at first and second ends of the shutter assembly, said first shutter end section and said second shutter end section being rigidly secured to the first and second side rails so as to separate the first and second side rails; and at least one raised plastic panel being rigidly secured to the first and second side rails, said at least one raised panel including a central raised panel portion defined by first and second panel side sections and first and second panel end sections, said first and second panel side sections and first and second panel end sections being lowered sections that give the raised panel portion its raised appearance, said at least one raised panel being formed by cutting the at least one raised panel to a desired length resulting in one unfinished edge, at least one of the first and second panel end sections being a separate member fabricated separately from the raised panel portion and shaped to conform to said unfinished edge, said separate member including an extended flange that is positioned against a back surface of the raised panel portion, said extended flange being secured to the raised panel portion adjacent said unfinished edge during assembly of the shutter assembly to produce a fully formed raised panel having a precisely desired length.

2. The shutter assembly according to claim 1 wherein the raised panel portion comprises an injection molded plastic raised panel portion and the separately fabricated panel end section comprises an injection molded plastic panel end section.

3. The shutter assembly according to claim 2, further comprising a pair of said raised panel end sections each being fabricated separately from the raised panel portion, and wherein said raised panel portion is cut at opposite longitudinal ends to produce a pair of unfinished edges producing an unfinished appearance to said raised panel and said pair of said raised panel end sections are secured to opposite ends of the raised panel portion.

4. The shutter assembly according to claim 1 wherein the raised panel portion includes a panel end section that is formed integrally with the raised panel portion.

5. The shutter assembly according to claim 1, further comprising a plurality of said raised panels, where each said raised panel includes at least one raised panel portion and at least one panel end section formed separately from the raised panel portion.

6. The shutter assembly according to claim 5, wherein the plurality of raised panels includes a first raised panel, a secondary raised panel and a tertiary raised panel, said first raised panel including first and second panel end sections, said secondary raised panel including first and second panel end sections, and said tertiary raised panel including one said panel end section that is formed integrally with the tertiary raised panel.

7. The modular shutter assembly according to claim 1 wherein the at least one raised panel comprises a die cut raised panel.

8. The shutter assembly according to claim 1 further comprising a louver section.

9. The shutter assembly according to claim 1 wherein the panel end section is ultrasonically welded to the raised panel portion.

10. A modular shutter assembly comprising an assembly of separately formed plastic parts, said separately formed plastic parts including:

a raised plastic panel portion including a central raised panel portion defined by first and second panel side sections and first and second panel end sections, said first and second panel side sections and first and second panel end sections being lowered sections that give the raised panel portion its raised appearance, at least one of the first and second panel end sections being a separate member fabricated separately from the raised panel portion, said separate member including an extended flange, said raised panel portion being cut to a desired length resulting in said raised panel portion having at least one unfinished edge, and said separately fabricated panel end section having an edge that conforms in shape to said unfinished edge of said raised panel portion;

said extended flange of the separate member being positioned against a back surface of the central raised panel portion and being secured to the central raised panel portion such that said separately fabricated panel end section abuts said unfinished edge of said raised panel portion to produce a fully formed raised panel having an integrally formed appearance.

11. The shutter assembly according to claim 10 wherein the assembly of separately formed plastic parts further includes at least two said separately fabricated panel end sections and said raised panel portion having a pair of cut edges resulting in a pair of said unfinished edges, and where the at least two panel end sections are each complimentany in shape to the unfinished edges and secured to opposite ends of the raised panel portion to provide the appearance that said raised panel is a single piece component.

12. The shutter assembly according to claim 10 wherein the raised panel portion includes an integrally molded panel end section.

13. The shutter assembly according to claim 10 wherein the at least one panel end section is ultrasonically welded to the raised panel portion.

14. A method of providing a modular shutter assembly, said method comprising the steps of:

providing first and second side rails of the shutter assembly;

providing at least one raised plastic panel of the shutter assembly, said raised panel including a central raised panel portion defined by first and second panel side sections and first and second panel end sections all being integral with each other, said first and second panel side sections and said first and second panel end sections being lowered sections that give the raised panel portion its raised appearance;

cutting at least one end of the at least one plastic raised panel including cutting through the raised panel portion, to cut the raised panel to a desired length and form a cut raised panel having an unfinished edge;

providing at least one separate panel end section having an edge that conforms in shape to said unfinished edge and securing the separate panel end section to the unfinished edge of the raised panel such that the raised panel includes a central raised panel portion defined by the integral first and second panel side sections and the separate panel end section such that the raised panel portion retains its raised appearance; and securing the cut and formed raised panel to the first and second side rails.

15. The method according to claim 14 wherein the step of providing at least one raised panel includes injection molding the raised panel and the step of providing at least one panel end section includes injection molding the panel end section.

16. The method according to claim 14 wherein the step of providing at least one panel end section includes providing first and second panel end sections that are formed separately from the at least one raised panel and the step of cutting includes cutting two ends of the at least one plastic raised panel each of the first and second panel end sections being rigidly secured to the at least one raised panel at opposite ends of the at least one raised panel.

* * * * *